United States Patent [19]

Jankovsky

[11] Patent Number: 4,475,575

[45] Date of Patent: Oct. 9, 1984

[54] CATCHING MECHANISM FOR A WEAVING MACHINE

[75] Inventor: Frantisek Jankovsky, Winterthur, Switzerland

[73] Assignee: Sulzer Brothers Limited, Winterthur, Switzerland

[21] Appl. No.: 408,925

[22] Filed: Aug. 17, 1982

[30] Foreign Application Priority Data

Sep. 30, 1981 [EP] European Pat. Off. ..... 81810395.4

[51] Int. Cl.[3] ..... D03D 47/24

[52] U.S. Cl. ..... 139/439

[58] Field of Search ..... 439/429, 437, 438, 439

[56] References Cited

U.S. PATENT DOCUMENTS

| | | | |
|---|---|---|---|
| 2,696,222 | 12/1954 | Pfarrwaller | 139/439 |
| 4,320,785 | 3/1982 | Zwiener | 139/429 |
| 4,338,973 | 7/1982 | Stauner | 139/439 |

*Primary Examiner*—Henry Jaudon

*Attorney, Agent, or Firm*—Kenyon & Kenyon

[57] ABSTRACT

The guide channel of the catching mechanism is provided with a recess into which the foremost projectile can be positioned at the upper end. The projectile is thus permitted to be moved into an upright position parallel to the direction of ejection. Further, the ejector is able to strike against the foremost projectile during ejection over a relatively large surface area so as to reduce the stress of the impact forces on the projectile.

9 Claims, 10 Drawing Figures

CATCHING MECHANISM FOR A WEAVING MACHINE

This invention relates to a catching mechanism for a weaving machine. More particularly, the invention relates to a guide for transferring a gripper projectile from a catching mechanism to a return transport means.

Heretofore, it has been known to provide weaving machines with suitable mechanisms, such as gripper projectiles, for inserting weft threads into a shed of warp threads. In such cases, each gripper projectile, in turn, grips an end of weft thread and is propelled through the shed from a picking mechanism on one side of the shed into a catching mechanism on the opposite side of the shed. After being caught, each projectile is returned to the picking mechanism via a suitable return transport means.

In some cases, the catching mechanisms which have been used to employ an ejector for ejecting the projectile from the catching mechanism into the return transport means, for example as described in U.S. Pat. No. 4,338,973. In these cases, the catching mechanisms have had a curved channel for sequentially receiving a series of projectiles to be returned to the transport means. In addition, the ejector has been mounted so as to be reciprocally movable in a straight line path into and out of a vertical section of the channel for the ejection of the foremost projectile. A pawl has also been provided in order to retain the projectiles by moving into a blocking position in the channel.

However, it has been found that the curved channel and the parts limiting the channel of such catching mechanisms are not optimally formed with respect to the passage of the projectiles. As a result, this may easily cause wear on the wall of the curved channel, on the ejector and on the pawl after a relatively short time.

Accordingly, it is an object of the invention to reduce the wear on the guide parts of a catching mechanism for gripper projectiles.

It is another object of the invention to modify existing catching mechanisms in a simple way to reduce wear.

It is another object of the invention to reduce the wear on gripper projectiles being returned from a catching mechanism to a return transport means in a weaving machine.

Briefly, the invention provides a catching mechanism for a weaving machine which has a curved channel for receiving a sequential series of weft insertion gripper projectiles and an ejector for sequentially ejecting each projectile from the channel.

In accordance with the invention, the curved channel has an outer wall in which a recess is provided for receiving a foremost one of the projectiles in a position parallel to a direction of ejection from the channel. In addition, the ejector is reciprocally movable in a straight line path into and out of the channel in a direction parallel to the direction of ejection.

The catching mechanism also has a pawl which is movable between a blocking position in the channel to retain a series of projectiles in the channel and a release position spaced from the channel to permit passage of a projectile. The pawl is also provided with a bearing surface for abutting the foremost projectile which is complementary to an abutted surface of the foremost projectile.

The recess within the curved guide channel is such that the foremost projectile assumes a position parallel to the direction of ejection upon striking against the pawl when in the blocking position. By positioning the projectile in this fashion before ejection, the ejector can strike a respective surface of the projectile over a relatively large impact surface of the ejector for the purpose of ejection. Since the projectile is set in the direction of projection and since relatively large impact surfaces come together, the stress on the surfaces is relatively low. As a result, the parts are treated gently and are worn less rapidly. Furthermore, the projectile is prevented from undergoing a torque in the curved channel as the ejector strikes, for example as could happen if the projectile takes up a position which is oblique to the direction of ejection. In this way, a longer life of the parts can be achieved.

These and other objects and advantages of the invention will become more apparent from the following detailed description taken in conjunction with the accompanying drawings wherein.

Figure 1:
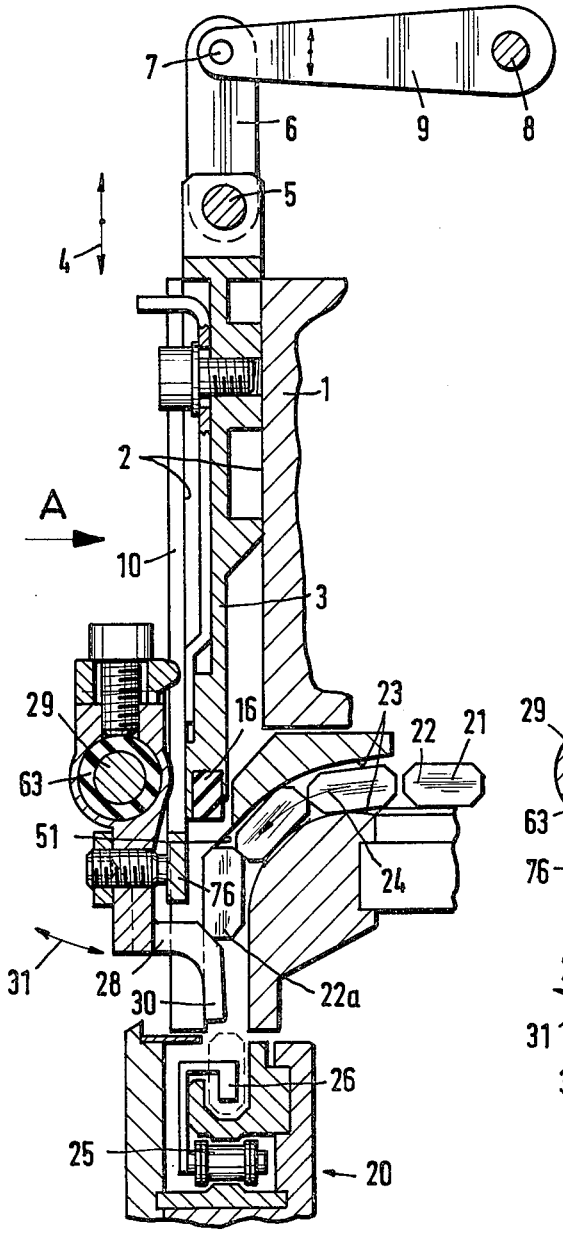
FIG. 1 illustrates a vertical sectional view through a catching mechanism constructed in accordance with the invention.

Referring to FIG. 1, the catching mechanism 1 is employed with a weaving machine which uses a plurality of gripper projectiles 22 to pick weft threads sequentially into successive sheds of warp threads or yarns along a picking line 21. To this end, the weaving machine has a picking unit (not shown) for picking a gripper projectile 22 through a shed of warp yarns to the catching mechanism 1.

As indicated, the catching mechanism serves to catch and transfer a series of gripper projectiles to a return transport means 20 for return to the picking unit. The catching mechanism includes a housing 1 having a curved channel 23 for guiding a series of received projectiles 22 from one end to an opposite terminal end. In addition, a rectilinear or straight-line guide 2 is provided in the housing 1 in which an ejector 3 is reciprocally mounted for movement in a direction indicated by the arrow 4 into and out of the channel 23 to eject the foremost projectile 22*a*.

As shown in FIG. 1, the upper end of the ejector 3 is articulated via a pin 5 to a Pitman link 6 which, in turn, is connected via a pin 7 to a pivotal drive lever 9 which is mounted for pivoting about a fixed pivot 8. The lower end of the ejector 3 carries an elastic foot piece 16, for example of rubber, for striking against the foremost projectile 22*a* at ejection.

A pivotal lock pawl 28 is disposed at the terminal end of the channel 23 for releasably holding the foremost projectile 22*a* in the channel 23. This pawl 28 is mounted about a fixed axle 29 so as to pivot in the direction indicated by arrow 31 between a blocking position in the channel 23 to retain the series of projectiles 22 in the channel (see FIG. 1) and a release position spaced from the channel 23 to permit passage of a foremost projectile 22*a* (see FIG. 2). The pivoting of the pawl 28 from the blocking position occurs counter to the action of an elastic bushing 63 which is inserted between the pawl 28 and the axle 29. Preferably, this bushing 63 is secured to each of the pawl 28 and axle 29, as by vulcanizing. The spring action of the bushing 63 thus biases the pawl 28 to move into the blocking position of FIG. 1.

Figure 4:
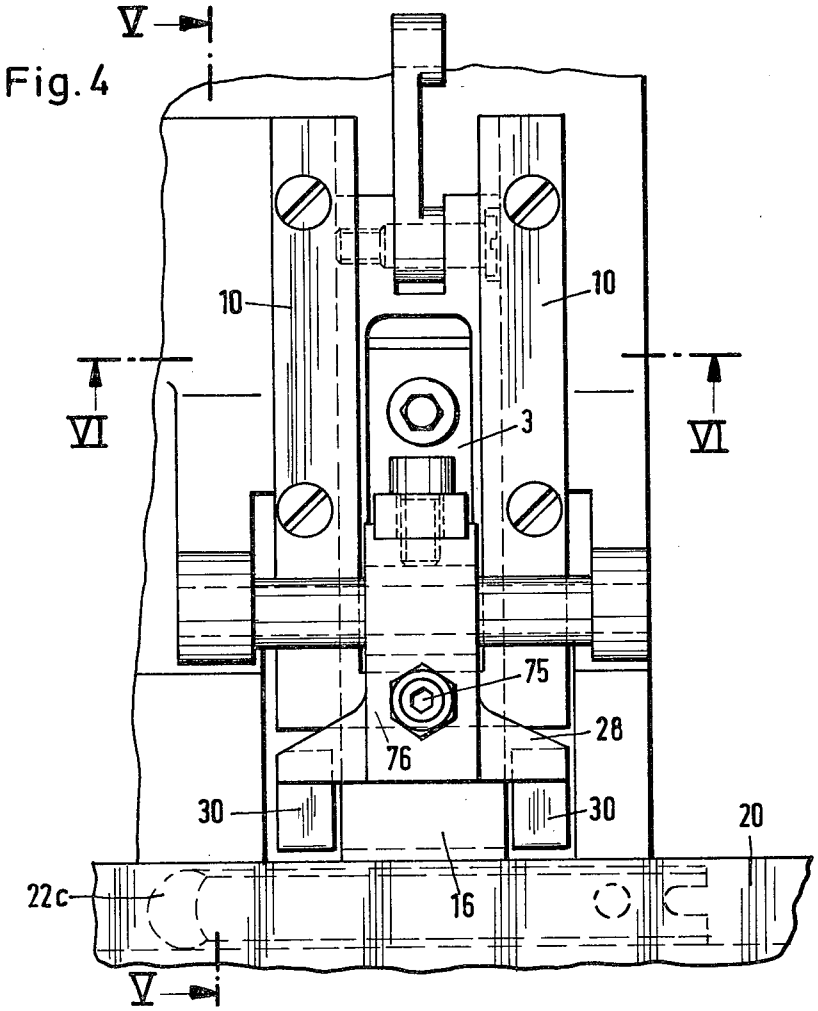
FIG. 4 illustrates a front view taken in the direction of the arrow A of FIG. 1.

Referring to FIGS. 1 and 4, the pawl 28 carries a pair of horizontally spaced apart locking shoulders 30 on the lower end which project into the curved channel 23 to abut against the foremost projectile 22*a*. Because of the elastic support of the pawl 28 via the elastic bushing 63, the shoulders 30 press against the foremost projectile 22*a* in a uniform matter independently of any tolerance-related defects. This is of importance especially in the ejection phase indicated in FIG. 2. The foremost projectile 22*a* is thus held uniformly at the front and rear ends by the pawl 28 and receives the same pressing force when sliding by the two shoulders 30 during ejection. Thus, the foremost projectile 22*a* can be deposited into the return transport means 20 in a horizontal position 22*c* as indicated in FIG. 4 in dotted lines.

The return transport means 20 consists of a roller chain 25 and several drivers 26 which pass below the channel 23 at an ejection station.

Figure 3:
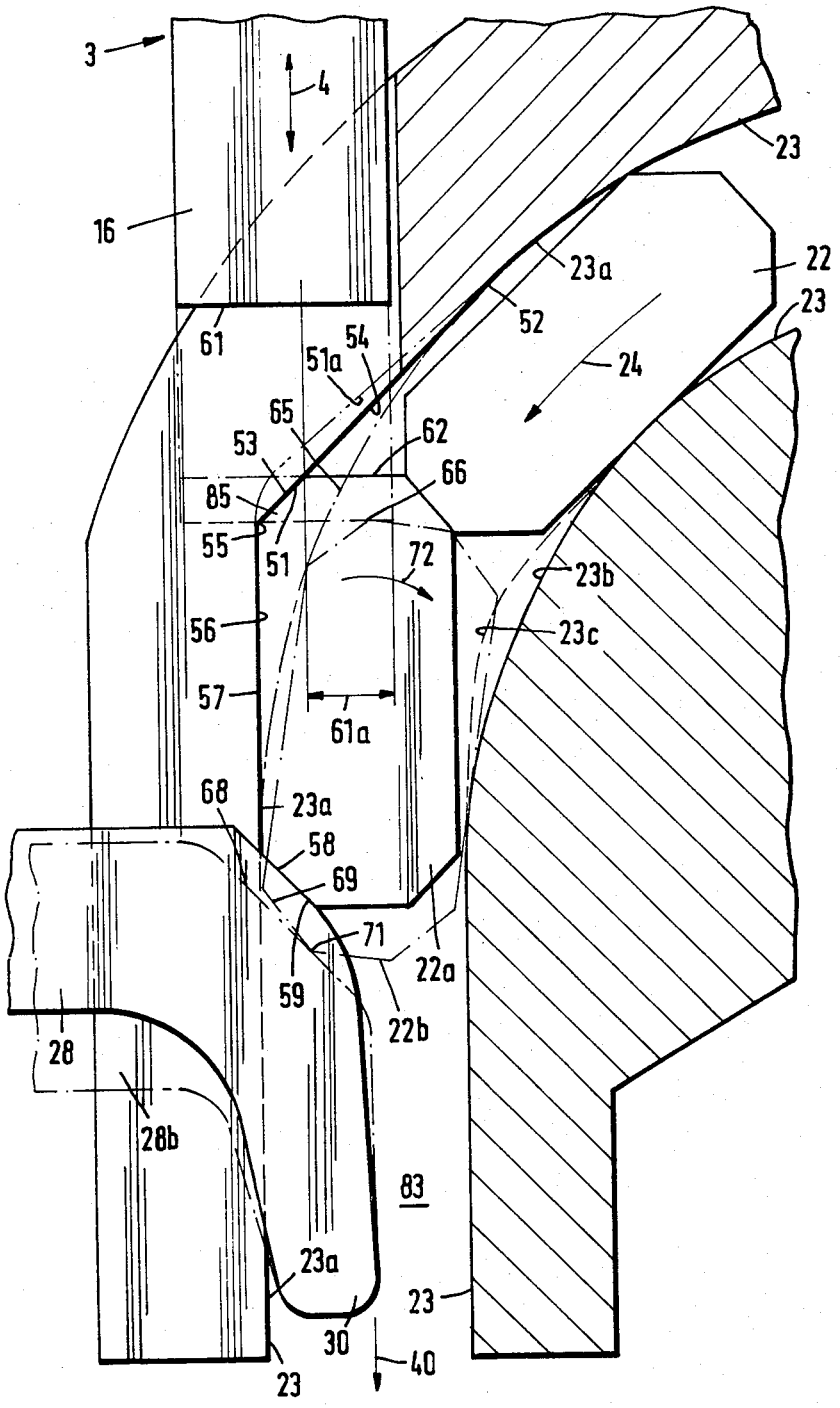
FIG. 3 illustrates an enlarged view of a foremost projectile abutted against a pawl in accordance with the invention.
Figure 6:
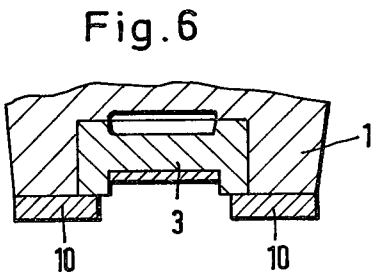
FIG. 6 illustrates a view taken on line VI—VI of FIG. 4.
Figure 5:
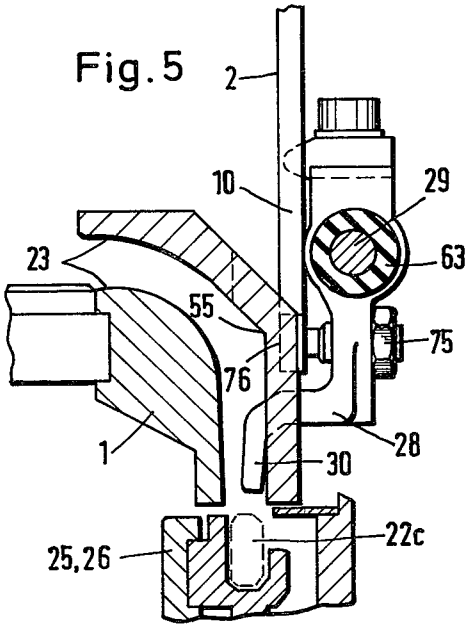
FIG. 5 illustrates a view taken on line V—V of FIG. 4.

Referring to FIG. 3, the curved channel 23 includes an outer wall 23*a* which is provided with a recess 51 for receiving the foremost projectile 22*a* in a position parallel to the direction of ejection from the channel 23. As indicated, the outer wall 23 extends in a straight line from a point 52 towards the left, as viewed, to form a limiting surface 54 which extends with the same slope as a sloped surface 53 on a corner of the foremost projectile 22*a*. This limiting surface 54 terminates at an edge 55 of the recess 51. Thereafter, the outer wall 23*a* has a vertical surface 56 corresponding to a vertical wall 57 of the projectile 22*a*. The outer wall 23*a* is likewise vertical at the terminal end 83 of the channel 23.

The form of the recess 51 is such that the foremost projectile 22*a* can move into a vertical position as shown in FIG. 3 under the action of centrifugal force (which is directed to the left in FIG. 3) and under the action of the pushing force of the next following projectiles 22. Thus, the projectile 22*a* can be positioned in an upright position parallel to the direction of ejection 40 from the channel 23 while the upper lefthand portion 85 finds room in the recess 51. Expediently, the two limiting surfaces 54, 56 of the recess 51 are adapted in form, position and with respect to the angle at the edge 55 as accurately as possible to the corresponding walls 53, 57 of the foremost projectile 22*a*.

As also shown in FIG. 3, the pawl 28 has a bearing surface 58 for abutting the foremost projectile 22*a* which is complementary to the abutted surface, i.e. the sloping wall 59, of the projectile 22*a* which is supported thereon.

As further shown in FIG. 3, the foot piece 16 of the ejector 3 has a horizontal surface 61 at the bottom which, in the right hand region 61*a*, is capable of striking against a corresponding horizontal wall or surface 62 of the foremost projectile 22*a*.

During use, after weft insertion along a picking line 21 (as shown in FIG. 1), a gripper projectile 22 moves into the catching mechanism 1 and is braked to a stop. The projectile 22 is then moved into the channel 23 via a suitable mechanism (not shown) and is moved with the other received gripper projectiles 22 successively along a path as indicated by the arrow 24. Because of the centrifugal force imparted to the projectiles 22 when moving about the curved channel 23 and the forces imposed by the trailing projectiles 22, the foremost projectile 22*a* is moved into a position parallel to the direction of ejection 40. That is, the foremost projectile 22*a* takes up a position abutting the pawl 28 and with the surfaces 57, 53 abutting the wall surfaces 54 in the recess 51 and the vertical surface 56.

Figure 2:
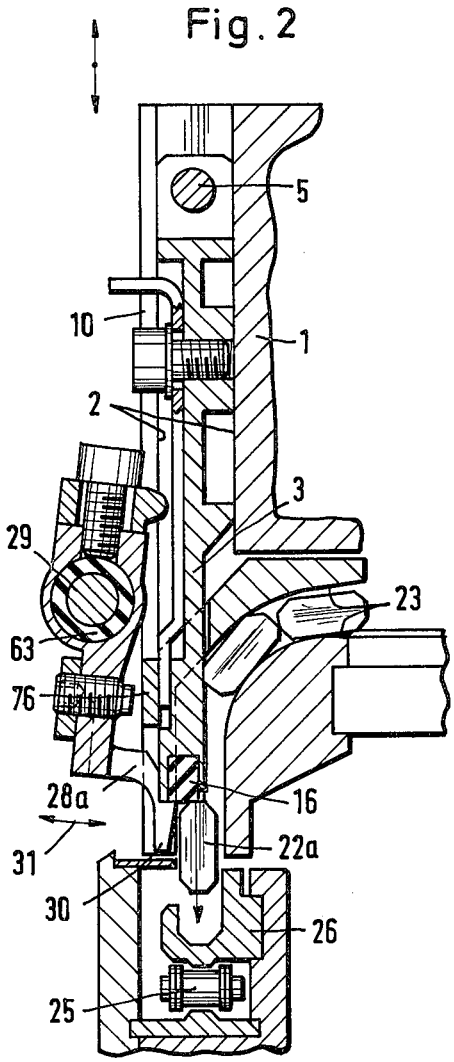
FIG. 2 illustrates a view similar to FIG. 1 of the ejector in an ejection position.

After each weft insertion, the ejector 3 is moved downwardly in a straight line in the direction of ejection 40. Initially, the foot piece 16 strikes against the upper horizontal wall or surface 62 of the projectile 22*a*. Upon further downward movement, the projectile 22*a* is pushed past the pawl 28 as the pawl 28 pivots into a release position as indicated in FIG. 2.

For purpose of comparison with previously known structures, FIG. 3 illustrates a dash-dot lines the form of a guide arrangement of previously known construction. As indicated, the outer wall of the channel 23 in continuously curved so that in the zone 65, the projectile 22*b* cannot assume a vertical position. Thus, the ejector 3 would strike along a line type of contact at 66 such that the parts would be subjected to relatively great wear.

As also shown in FIG. 3, in the known form of construction, the pawl 28*b* has a bearing surface 68 that does not have the same inclination as the sloping wall 69 of the projectile 22*b* being held. This also results in a line type of contact 71 of the projectile 22*b* and the pawl 28*b*. This also causes increased wear on the pawl 28*b* as well as on the projectiles.

Further, in the previously known construction, where the ejector 3 impinges at the line of contact 66, a torque would act on the projectile 22*b* about the line contact 71 in the direction indicated by the arrow 72. Because of this, the projectile 22*b* might exert a pressure on the inner wall 23*b* of the curved channel in an undesirable manner. However, with the parts illustrated in solid lines in FIG. 3, no torque is exerted on the projectile 22*a* during ejection.

Figure 7:
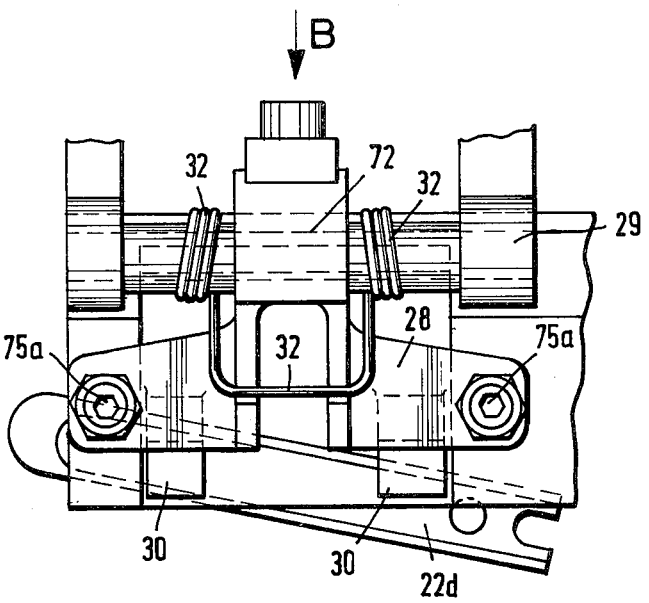
FIG. 7 illustrates a front view of a known arrangement corresponding to FIG. 4.
Figure 8:
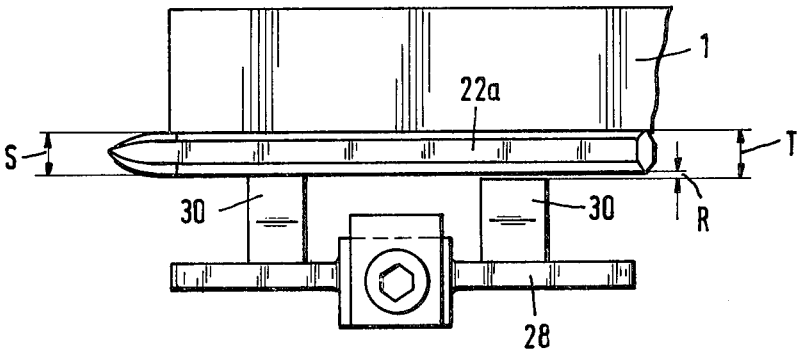
FIG. 8 illustrates a top view taken in the direction of arrow B of FIG. 7.

For purposes of comparison, FIGS. 7 and 8 illustrate a known construction wherein a pawl 28 is mounted by means of a slide bearing 72 on axle 29 and is biased by a spring 32. As indicated, this pawl 28 has a pair of wings which are provided with suitable apertures for passage of stop screws 75*a* there through. These stop screws 75*a* serve as stops for limiting the outward motion of the pawl 28 relative to the channel (not shown) in which the projectiles 22 are located. With this construction, the foremost projectile 22*a* would be held by the two locking shoulders 30 when the pawl 28 is in the blocking position. As indicated in FIG. 8, the foremost projectile 22*a* would be held within a penetration slot S at the front of the projectile 22*a* and a penetration slot T at the rear. However, as further indicated in FIG. 8, it is possible that a gap R would occur between the rear locking shoulder 30 and the rear of the projectile 22*a* during the ejection phase. Should this occur, the projectile 22*a* may take up the oblique position 22*d* as indicated in FIG. 7, even when the parts are machined with precision with the narrowest tolerances.

In order to overcome this above problem, a U-shaped plate 10 is mounted on the housing 1 with the legs of the plate 10 forming a wall of the guide 2 for the ejector 3. In addition, the pawl 28 is provided with a single stop screw 75 located in a center position to strike against a bottom web 76 of the plate 10. By disposing the stop screw 75 in the center of the pawl 28, the parts may have wider tolerances than is the case with the construction illustrated in FIGS. 7 and 8.

Figure 9:
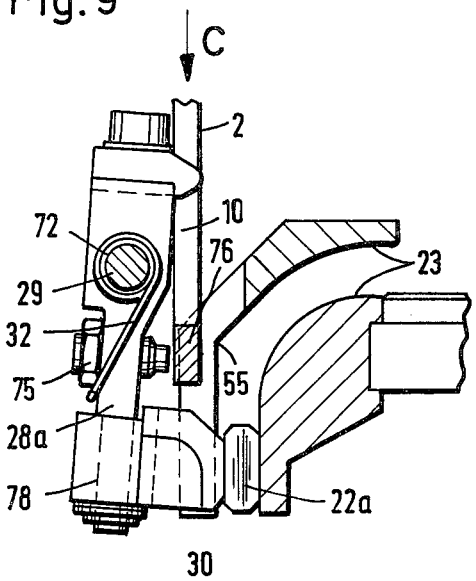
FIG. 9 illustrates a side view of a modified pawl in accordance with the invention.
Figure 10:
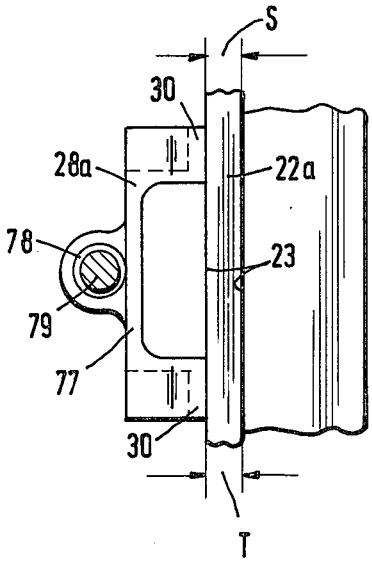
FIG. 10 illustrates a top view taken in the direction of arrow C of FIG. 9.

Referring to FIGS. 9 and 10, wherein like reference characters indicate like parts as above, the two locking shoulders 30 of the pawl 28 may be arranged on a common support 77 which, in turn, is pivotal via a slide bearing 78 on a vertically disposed axle 79 of the pawl 28. In addition, the pawl 28 is mounted without play in a slide bearing 72 and is biased by a spring 32 towards the guide channel 23, for example in a manner as indicated in FIG. 7. Of note, a bushing such as the bushing 63 described above is omitted here.

By freely pivoting the support 77, the two penetration slots, T at the front and rear of the projectile **22*a* are the same, even for relatively wide tolerances of the parts. Thus, the foremost projectile 22*a* can be ejected into the return transport means (not shown) in a horizontal position 22*c* (see FIG. 4). Thus, the oblique position 22*d* as indicated in FIG. 7** can be avoided.

Referring to FIG. 3, the guide channel 23 may be modified on the inner wall as indicated by the broken line **23*c*. In addition, the recess 51 in the outer wall may be more or less rounded at the end or transition point 55. This is to be considered particularly when the projectile 22*a* has a rounded form. If desired, the position of the foremost projectile 22*a* may differ slightly from a vertical position; but, in any event, only to the extent that the ejector 3 can still impinge via the foot piece 16 on the projectile with an area contact. This permits the advantageous impact effect to be preserved without the occurrence of a torque as indicated by the arrow 72**.

If the bearing bushing 63 is not connected with the pawl 28 and pivot 29 by vulcanization, the bushing 63 serves only for elastic support and hence for the self-centering effect of the pawl 28 with respect to the projectile **22*a* to be held. In this case, a spring 32 becomes necessary for achieving the spring effect of the pawl 28**.

If a projectile 22 has a cross section different from the polygonal cross section shown in FIGS. 1 and 3, for example, a cross section rounded at the two short sides, the recess 51 is expediently adapted to the profile cross section. The recess 51 can then extend, for instance, along the line **51*a* as indicated in dash-dot-dot lines in FIG. 3. Further, the bearing surface 58 of the pawl 28 is expediently adapted to the profile of the projectile 22, in any case, in such a way that there is an area contact between the surfaces 58, 59**.

The invention thus provides a catching mechanism in which a projectile can be positioned into the direction of ejection before injection. In addition, the ejector is able to strike against the projectile over an area of contact so as to distribute the impact forces over a greater area. Ejection of the projectiles is able to take place under reduced wear and without a torque acting on the projectiles.

What is claimed is:

1. A catching mechanism for transferring a gripper projectile to a return transport means; said mechanism comprising a housing having a curved channel for guiding a series of received projectiles from one end to an opposite terminal end, said channel including an outer wall and a recess in said outer wall for receiving a foremost one of the series of projectiles in a position parallel to a direction of ejection from said channel;

a pivotal lock pawl disposed in said channel at said terminal end for releasably holding the foremost projectile in said position in said channel;

a rectilinear guide; and an ejector reciprocally mounted in said guide for movement into said channel parallel to said direction of ejection to eject the foremost projectile from said channel upon pivoting of said lock pawl from said channel.

2. A catching mechanism as set forth in claim 1 wherein said lock pawl has a bearing surface for abutting the foremost projectile complementary to an abutted surface of the foremost projectile in said position.

3. A catching mechanism as set forth in claim 1 which further includes an axle mounted on said housing for pivoting of said lock pawl thereon and an elastic bearing bushing between and fixed to said axle and said lock pawl.

4. A catching mechanism as set forth claim 1 wherein said lock pawl includes a single adjustable stop abutting said housing to adjust the penetration of said lock pawl into said channel.

5. A catching mechanism as set forth in claim 1 which further includes an axle with said lock pawl pivotally mounted on said axle and wherein said lock pawl includes a support having a pair of horizontally spaced lock shoulders for passage into said channel to abut the foremost projectile, said support being pivotally mounted on an axis perpendicular to said axle.

6. A catching mechanism as set forth in claim 1 wherein said recess includes a pair of limiting surfaces, one of said limiting surfaces extending on a slope corresponding to a sloped surface on a corner of the foremost projectile and the other of said limiting surfaces extending vertically.

7. A catching mechanism for a weaving machine; said catching mechanism having a curved channel for receiving a sequential series of weft insertion gripper projectiles, said channel including an outer wall with a recess for receiving a portion of an upper end of a foremost one of the series of projectiles in a vertical position parallel to a direction of ejection from said channel; and an ejector for sequentially ejecting each projectile from said channel, said ejector being reciprocally movable in a vertical straight line path parallel to said direction into and out of said channel to abut the upper end of the foremost projectile.

8. A catching mecahnism as set forth in claim 7 further comprising a pawl movable between a blocking position in said channel to retain a series of projectiles in said channel with a foremost projectile in a vertical position and a release position spaced from said channel to permit passage of the foremost projectile.

9. A catching mechanism as set forth in claim 8 said pawl has a bearing surface for abutting the foremost projectile complementary to an abutted surface of the foremost projectile.

* * * * *